US005356057A

United States Patent [19]

Vossen

[11] Patent Number: 5,356,057

[45] Date of Patent: Oct. 18, 1994

[54] MEANS FOR PUTTING ON THERAPEUTIC ELASTIC STOCKINGS

[75] Inventor: Johannes G. H. M. Vossen, Nieuwstadt, Netherlands

[73] Assignee: Stichting Medische Technologie, Netherlands

[21] Appl. No.: 839,776

[22] PCT Filed: Oct. 10, 1990

[86] PCT No.: PCT/NL90/00148

§ 371 Date: Apr. 16, 1992

§ 102(e) Date: Apr. 16, 1992

[87] PCT Pub. No.: WO91/05498

PCT Pub. Date: May 2, 1991

[30] Foreign Application Priority Data

Oct. 23, 1989 [NL] Netherlands ..... 8902619

[51] Int. Cl.[5] ..... A47G 25/90

[52] U.S. Cl. ..... 223/112; 223/111g30101

[58] Field of Search ..... 223/111, 112; 36/9 R, 36/10, 138; 2/239

[56] References Cited

U.S. PATENT DOCUMENTS

| | | | |
|---|---|---|---|
| 3,401,856 | 9/1968 | Berlin | 223/111 |
| 4,204,345 | 5/1980 | Bradley | 36/10 |
| 4,538,368 | 9/1985 | Mugford | 36/138 |
| 4,858,795 | 8/1989 | Selinko | 223/111 |
| 4,943,097 | 7/1990 | Sanger | 223/111 |

FOREIGN PATENT DOCUMENTS

| | | | |
|---|---|---|---|
| 478051 | 5/1929 | Fed. Rep. of Germany . | |
| 2852361 | 6/1979 | Fed. Rep. of Germany | 223/111 |
| 788477 | 10/1935 | France . | |
| 2221604 | 2/1990 | United Kingdom | 223/111 |

*Primary Examiner*—Clifford D. Crowder
*Assistant Examiner*—Bibhu Mohanty
*Attorney, Agent, or Firm*—Dorsey & Whitney

[57] ABSTRACT

The means for putting on therapeutic elastic stockings consists of a sock of smooth material to cover the foot, the sock being provided with a lining of smooth and supple material. The lining has been partly attached to the sock, partly set free from it, the free part at the end being closed and having such a length that it can be taken out as far as outside the sock and can be turned in up to the toe of the sock, a situation that takes place when the sock is positioned round the foot of the user. Besides the lining is characterized by the fact that it is attached to the sock where the foot steps in and that the length of the free part of the lining is substantially equal to the length of the sock.

1 Claim, 2 Drawing Sheets

MEANS FOR PUTTING ON THERAPEUTIC ELASTIC STOCKINGS

Figure 1:
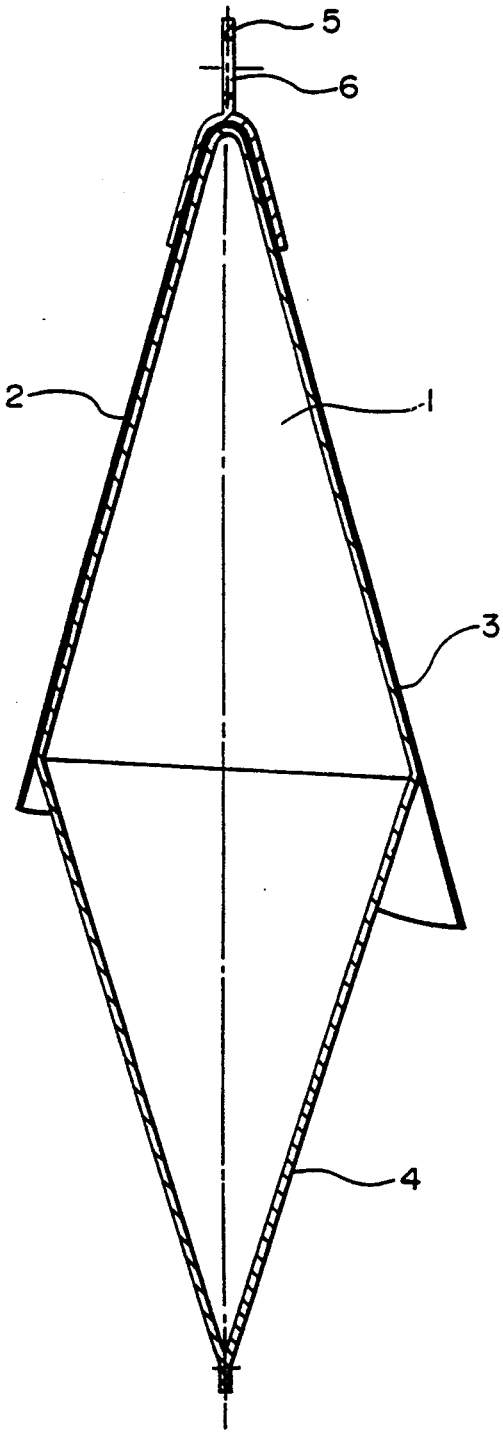

The present invention refers to a means for putting on therapeutic elastic stockings, having two open ends, that fits round the foot and can cover it, in the form of a slipper.

Therapeutic elastic stockings having two open ends, also called support stockings, are amongst others worn by sufferers from varicose veins or crural ulcers or in case of injuries such as contusions or sprains. The dimensions of such stockings have been choosen in such a way that the stockings, after putting them on, will have been stretched in circumferential direction, so that they apply a normal pressure upon the skin.

The stocking being put on, this normal pressure is still enlarged as a result of the elasticity in pulling direction taking place at the same time, especially on those places where the stockings is pulled over vaultings of the foot, such as the heel.

The power necessary for putting on the stocking being proportionate to the prevailing normal pressure and the coefficient of friction between the stocking and the foot, is therefore rather large.

Putting on a stocking having two open ends, to lower the friction between the therapeutic elastic stocking and the foot it is known e.g. from FR-A-788.477 that was published on Oct. 10, 1935 to use special socklets made of a material having an outer and inner surface of low friction, the friction of the inner surface preferably being somewhat higher than that of the outer surface. These socklets having more or less the form of a slipper, cover the foot at the upperside up to the instep and at the underside up to the heel and at the same time protect the stockings, being put on, against damage by toenails.

In order to cover the legs of the user with normal stockings or a panty and to wear shoes after putting on the therapeutic elastic stockings the socklet is removed by pulling it or by pulling a tab attached to it. To this end the therapeutic elastic stocking has an open toe allowing the socklet to be pulled off.

As one pulls off a normal sock, this goes without any effort by taking this sock at the upper edge and stripping it off the foot or by putting one's hand between the upper edge of the sock and the leg and stretching the sock a little bit in radial direction and then pushing it off the foot. Because the upper edge of the means as described above, after putting on the therapeutic elastic stocking, is covered by said stocking these actions cannot be practised here. Removing the means can only be effected by pulling its toe-part.

In this case on the one side the means is strongly subjected to the traction power, so that it should be made of firm slightly elastic material, while on the other hand, removing it the friction with the stocking as well as with the foot has to be overcome.

As besides the socklet sticks to the usually by perspiration damp foot, removing the means makes a rather great demand on a person's power. The pulling power is smallest when it is applied parallel to the foot, but many users are functionally limited to such a degree that they are not able to pull off the socklet parallel to the foot.

Usually they will pull the socklet or the tab attached to it towards themselves, such demanding a considerably greater effort. Besides the known socklets are of a rather stiff material, so that, especially when the therapeutic elastic stocking moves along the heel, it still costs a fairly great effort to pull this stocking over the foot while putting it on.

It is the object of the present invention to provide a means for putting on therapeutic elastic stockings having two open ends demanding considerably less power than the known means to put on these stockings and to remove the means.

According to the invention this is obtained by a means for putting on therapeutic elastic stockings having two open ends, that fits round the foot and can cover it, in the form of a slipper or in a similar form, which comprises at least on its outer side a surface of low friction and a lining (4) of supple material and having surfaces of low friction, said lining being partly attached to the slipper and partly set free from it, the free part being closed at the end and having such a length that when it is turned inside the slipper its closed end will abut at the toe end of the slipper, said means further comprising at its toe end a device for pulling the slipper away.

Preferably the device for pulling the slipper away from the foot is a tab provided with an eye. When the means, after putting on the therapeutic elastic stocking, is removed now by pulling the slipper or the tab attached to it, the lining is turned outside again being stripped as it were along itself.

In this way there is no frictional contact between the foot and the means. The only friction-resistance felt at the removing of the means is the little friction of the material of the lining against itself and the friction of the outer surface of the sock along the side of the therapeutic elastic stocking.

The lining is preferably made of a thin fabric, a so-called non-woven fabric or a film of a thermoplastic synthetic material, such as a polyalkene.

The friction resistance of the materials moving along each other during the "stripping", can be reduced by using a synthetic material, having a non blocking agent added to it, for example hydrotalcite.

The material used for the sock pulled over by the therapeutic elastic stocking is preferably a fabric coated with polythetrafluorethylene (teflon), such as a nylon fabric or a fibreglass cloth. Such a fibreglass cloth coated with teflon is commercially available from Eriks b.v. under the tradename "Chemglass PTFE fibreglass fabric 100-3". Such a material has a very low coefficient of friction and is strongly non blocking and resistant to atmospheric conditions and sunlight.

Moreover it is strong enough to resist without worth mentioning elasticity the tensile stress taking place as the sock is being pulled off.

Figure 2:
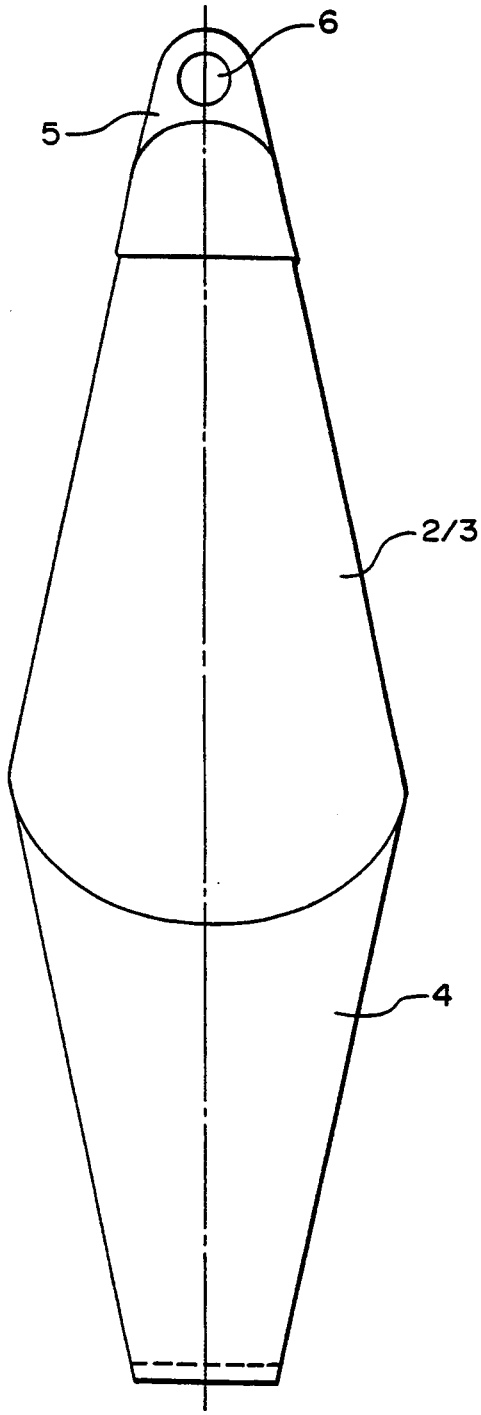
Figure 3:
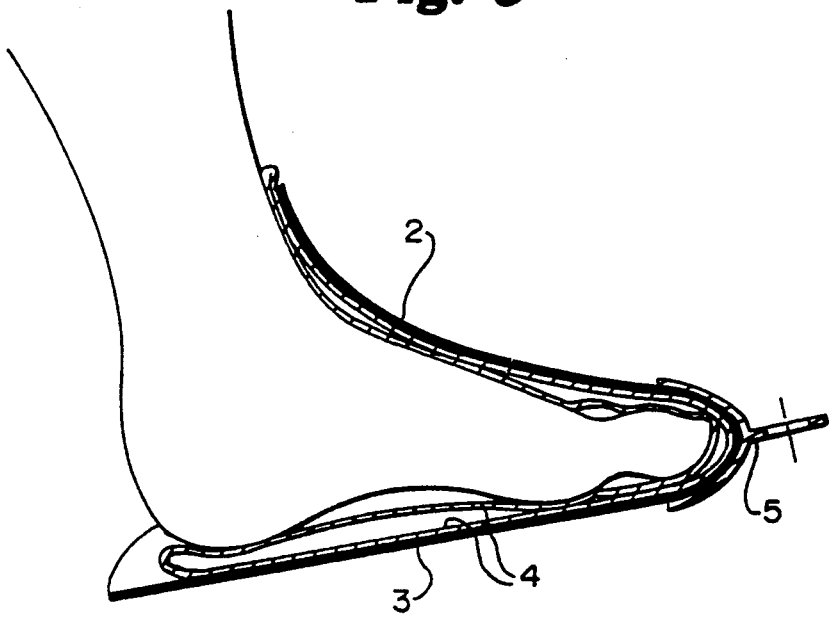

The invention will further be elucidated with reference to the embodiment shown in the drawings. Here shows:

FIG. 1 in longitudinal section a means according to the invention;

FIG. 2 a top view of the means as shown in FIG. 1;

FIG. 3 a longitudinal section of the means after putting it on; and

Figure 4:
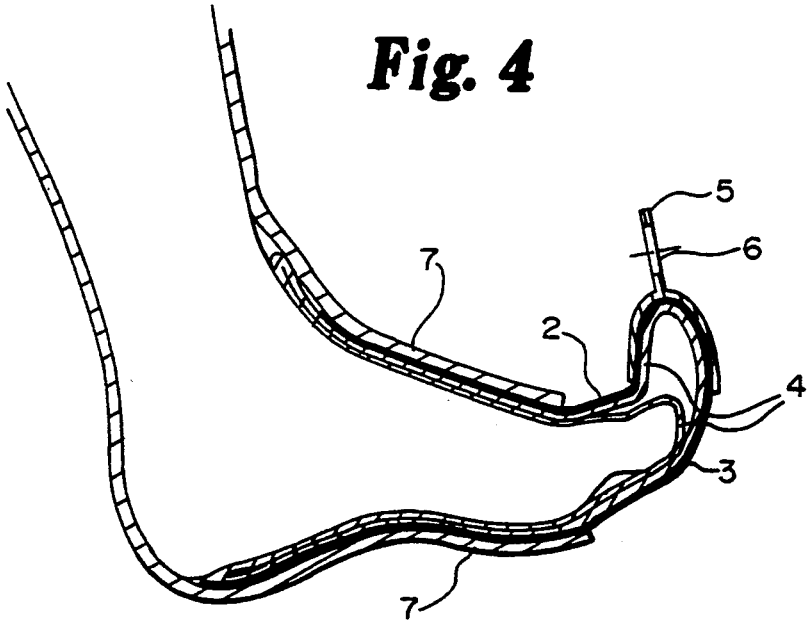

FIG. 4 a longitudinal section of the means when it is pulled off.

The means 1 as shown in the drawings has the shape of a slipper, the upper part 2 of it stretching beyond the instep and the bottom or solepart 3 finding itself round the heel of the user. The means is made of a fabric coated with teflon, such as a nylon fabric or a fibreglass cloth. Attached to the open end of the slipper is a lining 4, made of a thin material such as a polyethylene film.

The lining extends from this end to the toe of the slipper at the one end and beyond the slipper at the other end.

The part of the lining inside the slipper can be connected with the slipper all over its own length.

Attached to the other end is tab 5, provided with an eye 6. The tab can be made of any firm material such as leather or a string of a strong synthetic material.

Before the slipper is put on, lining 4 is turned in, as to be seen in FIG. 3. After the slipper has been put on, the therapeutic elastic stocking 7 is pulled over the slipper. Because the coefficient of friction of the slipper coated with teflon is low, relatively little power is required to put on the therapeutic elastic stocking.

After putting on the therapeutic elastic stocking means 1 has to be removed in order to enable the user to put on normal stockings or a panty on top of the therapeutic elastic stockings and to wear shoes. As shown in FIG. 4 for this purpose tab 5 is being pulled, so that the means will be removed from the therapeutic elastic stocking by way of the open toe. Because the lining 4, being pulled off like this, is stripped along itself now, no friction with the skin of the foot takes place, so that little pulling power is necessary and irritation of the skin by materials moving along it does not take place. It is true, friction takes place between the means and the therapeutic elastic stocking and between the materials of the lining moving along each other, but because of the low co-efficient of friction of the tefloncoating of the slipper and the lower friction-resistance as the synthetic materials move along each other, the needed pulling power is restricted.

The working of a means made of a known cotton fabric and the working of a means according to the invention were experimentally compared.

Using the cotton socklet and using the means according to the invention, either way the power required for putting on the therapeutic elastic stocking could not be measured objectively indeed, but seemed considerably less when using the means according to the invention.

The power necessary to pull off the cotton socklet, after putting on the therapeutic elastic stocking, could be measured and appeared to be at least 1,5 times larger than the power needed to pull off the means according to the invention.

The invention is not limited to the example as described above. Thus the lining with the open end can be attached to the slipper there where the foot steps in and for the remaining part can be loose. In this case the sock and the lining can consist of the same suitable material, such as a fibreglass cloth coated with teflon or nylon.

I claim:

1. Means for putting on therapeutic elastic stockings comprising:

an outer slipper having a first end and a second end, a slipper mouth near said first end for introduction of the foot of the user, a foot stop at said second end and means at its second end for pulling said slipper away, wherein said means comprises a tab (5) provided with an eye (6);

an inner lining, separate from said slipper and having a first end defining a lining mouth for introduction of the foot of the user and a second end defining a free end, said lining mouth being connected with said slipper mouth, said lining being disposed within and adjacent to said slipper and said lining being free of connection to said slipper except at its mouth.

* * * * *